US006749395B1

(12) United States Patent
Reichert et al.

(10) Patent No.: US 6,749,395 B1
(45) Date of Patent: Jun. 15, 2004

(54) DEVICE AND METHOD FOR CONTROLLING A COOLING AIR FLOW OF A GAS TURBINE

(75) Inventors: Arnd Reichert, Duisburg (DE); Dirk Lieser, Kassel (DE)

(73) Assignee: Siemens Aktiengesellschaft, Munich (DE)

( * ) Notice: Subject to any disclaimer, the term of this patent is extended or adjusted under 35 U.S.C. 154(b) by 133 days.

(21) Appl. No.: 10/048,810

(22) PCT Filed: Jul. 27, 2000

(86) PCT No.: PCT/EP00/07255

§ 371 (c)(1),
(2), (4) Date: Jan. 29, 2002

(87) PCT Pub. No.: WO01/09518

PCT Pub. Date: Feb. 8, 2001

(30) Foreign Application Priority Data

Jul. 29, 1999 (EP) ..... 99114280

(51) Int. Cl.[7] ..... F01D 7/00
(52) U.S. Cl. ..... 415/115; 416/97 R
(58) Field of Search ..... 415/115, 116; 416/97 R, 96 A; 60/39.75

(56) References Cited

U.S. PATENT DOCUMENTS

| | | | | |
|---|---|---|---|---|
| 2,656,096 A | | 10/1953 | Schwarz | |
| 2,957,306 A | | 10/1960 | Attinello | |
| 3,123,285 A | | 3/1964 | Lee | |
| 3,643,431 A | | 2/1972 | Jamieson | |
| 4,117,669 A | * | 10/1978 | Heller | 60/39.14 |
| 4,419,044 A | * | 12/1983 | Barry et al. | 415/117 |
| 4,668,162 A | * | 5/1987 | Cederwall et al. | 415/115 |
| 4,815,928 A | * | 3/1989 | Pineo et al. | 415/17 |
| 5,297,386 A | * | 3/1994 | Kervistin | 60/226.1 |
| 5,320,483 A | * | 6/1994 | Cunha et al. | 415/114 |
| 5,340,274 A | * | 8/1994 | Cunha | 415/115 |
| 5,488,825 A | * | 2/1996 | Davis et al. | 60/39.75 |
| 5,591,002 A | * | 1/1997 | Cunha et al. | 415/115 |
| 5,707,206 A | * | 1/1998 | Goto et al. | 415/173.1 |

FOREIGN PATENT DOCUMENTS

| | | |
|---|---|---|
| EP | 0192185 | 2/1986 |
| FR | 1.010.405 | 6/1952 |
| GB | 444103 | 3/1936 |

* cited by examiner

*Primary Examiner*—Edward K. Look
*Assistant Examiner*—J. M. McAleenan
(74) *Attorney, Agent, or Firm*—Harness, Dickey & Pierce, P.L.C.

(57) ABSTRACT

An apparatus for controlling a cooling air flow, in particular a gas turbine cooling air flow, is for the control, specific to requirement, of a cooling air flow using low-maintenance. A control fluid flow is introduced into the cooling air flow in the region of the flow duct with a flow component transverse to the flow direction of the cooling air flow through the flow duct. As such, the flow rate of the cooling air flow is adjustable as a function of control parameters of the control fluid flow and/or other parameters.

40 Claims, 3 Drawing Sheets

DEVICE AND METHOD FOR CONTROLLING A COOLING AIR FLOW OF A GAS TURBINE

This application is the national phase under 35 U.S.C. § 371 of PCT International Application No. PCT/EP00/07255 which has an International filing date of Jul. 27, 2000, which designated the United States of America, the entire contents of which are hereby incorporated by reference.

FIELD OF THE INVENTION

The invention generally relates to a gas turbine and method for controlling cooling of a gas turbine.

BACKGROUND OF THE INVENTION

An air-cooled gas turbine blade appliance is known from EP 0 768 448 A1. The rotor blades are inserted on rotatable carrier disks. Due to the hot air supplied for the operation of the gas turbine, temperature-sensitive regions of the gas turbine are also heated and can be subjected to damage by this. The rotor blades, which are inserted on the rotatable carrier disks driven by the hot air, are cooled by cooling air supplied from the carrier disk. For cooling purposes, cooling air supplied radially from the outside flows through the stationary guide blades. This is used, inter alia, for cooling carrier disk lateral spaces located between the rotor blades and the guide blades.

For feeding the cooling air to the carrier disk lateral spaces at the radially inner end of a guide blade, the guide blade has an opening through which the cooling air, which is led through an external cooling air supply duct, is fed. The discharge of the rest of the cooling air takes place, essentially, through a large number of small openings, so-called film cooling holes, in a so-called blade nose into the hot air flow, so that a cooling air film is formed on the outside of the gas turbine blade.

In the case of an unrestricted cooling air supply with the objective of maximum cooling, the efficiency of the gas turbine, which is essentially determined by the temperature of the hot gas introduced, is greatly reduced by the large quantities of cooling air supplied and the energy consumption of the gas turbine is essentially increased.

Control valves are inserted to combat this. In general, these are commercial valve shapes and are located radially outside on the guide blade or further upstream in the supply path of the cooling air, in the cooling air supply duct.

Although, on the one hand, this makes the valve easily accessible in order, for example, to carry out possible repairs or adjustments, it means, on the other hand, that only a simultaneous adjustment is possible of the pressure of the cooling air for the carrier disk lateral space and of the pressure of the cooling air which flows through the film cooling holes onto the blade nose. Where adjustment takes place to a very low cooling air pressure, this can easily lead to break-down of the cooling air film on the blade nose and, in consequence, there is no longer adequate cooling of the guide blade surface. If, on the other hand, the cooling air pressure is adjusted to be strong to produce an adequate cooling film, a powerful cooling air flow is produced in the hot air and this leads to a reduction in the power of the gas turbine and a high consumption of energy.

SUMMARY OF THE INVENTION

An object of the present invention is to provide a control of a cooling air flow. In the case of a gas turbine, in particular, an automatic gas turbine, adequate cooling of the carrier disk lateral space by a supply of cooling air should be reliably ensured independently of the operating conditions. Further, at the same time, a high gas turbine efficiency should be achieved.

This object is achieved by providing an appliance for controlling a gas turbine cooling air flow through a flow duct. In one embodiment, it includes, a control fluid flow which is introduced into the cooling air flow, in the region of the flow duct, with a flow component transverse to the flow direction of the cooling air flow through the flow duct. In one embodiment, it is possible to adjust the flow rate of the cooling air flow as a function of control parameters of the control fluid flow and/or by the introduction geometry of the control fluid flow into the cooling air flow and/or by the geometry of the flow duct.

This type of control is well suited for difficult access locations on machines or the like, which are also subjected to severe loads. The appliance operates almost independently of dirt or other environmental influences such as, for example, aggressive chemical attacks due to a corresponding cooling air flow. The control element is not subject to any wear and erosion-free switching is possible because of the contactless adjustment without, for example, electrical current or mechanical appliances. Such a control appliance therefore requires very little maintenance because the control of the cooling air flow takes place exclusively by way of a specially adjusted supply of a control fluid flow. In the case of a failure of the control system, the originally adjusted cooling air flow takes place at its basic setting in any event. Independently of the function of the control flow, the cooling air flow can be adjusted before the appliance is put into operation in such a way that it is sufficient for the desired function.

The control fluid flow intervenes in the flow behavior of the cooling air in such a way that it either accelerates or retards the flow, respectively increasing or lowering the flow rate. This essentially takes place by changes in the type of the active fluid flow in specified boundary or central regions of the cooling air flow in the flow duct. This is, in particular, also directed toward converting the flow from a laminar flow to a turbulent flow. The precondition is that the control fluid flow should have a flow component suitable for influencing the flow when flowing into the cooling air flow. This refers to a component of its main flow direction which is directed transverse to the flow direction of the cooling air flow through the flow duct. By this, the flow behavior of the cooling air flow is influenced in a predetermined manner.

The control fluid is advantageously air. It is also conceivable to supply to the active fluid a control fluid with a composition which is, to a certain extent, "neutral" with respect to the cooling air flow, such as an aqueous solution water.

The control fluid flow can, on the one hand, be adjusted in strength, or in its flow rate, and exerts, by this, a control influence on the cooling air flow. On the other hand, its introduction geometry, for example the angular position of the control fluid flow relative to the cooling air flow, or the arrangement of the control fluid flow relative to the cooling air flow, can be changed. Influence can also be effected by changing the geometry of the flow duct through which the cooling air flows. The possibilities mentioned for the control can be combined with one another, the flow rate or strength of the control fluid flow being adjusted after the installation of an appliance according to the invention in a machine. In the case of a fixed geometry, the control fluid flow is controlled by means of control parameters of the control fluid flow which, however, depend on the respectively selected geometry.

The flow rate of the cooling air flow can preferably be adjusted by adjusting the pressure of the control fluid flow. Stepless and very accurate adjustment of the control fluid flow can be achieved by this, which adjustment can be undertaken with little complexity. This appliance also requires very little maintenance because a control flow is flowing almost continuously so that the supply ducts of the control flow are kept free.

The flow rate of the control fluid is preferably small relative to the flow rate of the cooling air flow because, in this way, no changes are undertaken to the physical and chemical properties of the cooling air flow, for example pressure or temperature changes or changes to the chemical composition or to a cooling function. In the event of a failure of the control fluid flow, furthermore, the cooling air flow continues to be sufficient to satisfy the envisaged duties so that the system, in which the appliance is inserted for control purposes, is not subject to any essential disturbance due to the failure of the control system. The proportion of the control fluid flow which is introduced into the cooling air flow is, in total, preferably smaller than 50% and, in particular, smaller than 10% of the total flow. The overall flow resulting, which is composed of the control fluid flow and the cooling fluid flow, practically corresponds to the previously introduced cooling air flow.

A further advantage of the control of a large flow by a small flow is, in addition, the low energy usage which is necessary for this purpose, or the small consumption of control fluid flow.

In a special introduction geometry, the control fluid flow can be introduced radially into the cooling air flow in the flow duct, i.e. the control fluid flow is located centrally and at right angles, or at least with a flow component at right angles, to the flow duct. This achieves a non-uniform incident flow of cooling air. In this way, the flow is strongly swirled, the vortex strength depending on the control parameters of the control fluid flow. In this way, the cooling air flow rate is reduced more or less strongly. Given optimum adjustment of the introduction geometry and optimum control parameter values, the mass flow becomes minimal. Given specified introduction geometry, a continuous control of the cooling air flow from the normal value down to a minimum value can be undertaken by changing the control pressure.

In the case of different introduction geometry, the control fluid flow can be introduced in the manner of a secant into the cooling air flow through the flow duct, i.e. although the control flow continues to be located with at least a component at right angles to the cooling air flow direction, it is not arranged centrally, i.e. not at the maximum diameter of the flow duct, in the case of a cylindrical flow duct, but more or less laterally distant from it. Thus, the control fluid flow is introduced into the cooling air flow corresponding to a type of secant in the case of a cylindrical flow duct. This type of designation should not, however, be understood as a limitation to cylindrical flow ducts but can also be applied to other duct shapes. This special type of supply generates a swirl in the flow duct and, in particular, in the active fluid flow. This swirl stabilizes the cooling air flow and increases its flow rate. Depending on the control parameters of the control fluid flow, the flow rate correspondingly extends from that originally adjusted to a maximum value. The achievable values of the flow rate also depend greatly on the introduction geometry of the control fluid flow and the geometry of the flow duct in the case of both the tangential and the radial in-flow.

One geometry of the flow duct, which is advantageous in application, is that the flow duct has a nozzle and a downstream diffuser with a specified opening angle and that the control fluid flow can be introduced in a transition peripheral region between the nozzle and the diffuser. This configuration of the flow duct geometry permits very accurate control of the cooling air flow, which flows first through the nozzle and then through the diffuser, a very small control fluid flow, which is fed into the cooling air flow between the nozzle and the diffuser, being sufficient.

In the case of a radial arrangement of the introduction of the control fluid flow, as presented above, the control fluid flow is preferably introduced in the region of the beginning of the diffuser. The introduction of the control fluid flow achieves a non-uniform incident flow into the diffuser, by which the pressure recovery in the diffuser is reduced. A powerful supply of control fluid achieves almost complete disturbance of the incident flow so that, finally, the pressure recovery is almost completely prevented. In this way, the flow rate and the mass flow through the nozzle become minimal. If the control fluid flow fails, the originally adjusted flow of cooling air flows through the nozzle and the diffuser.

In the case of a tangential feed of the control fluid flow into the cooling air flow, the control fluid flow is preferably supplied to the central region of the nozzle. In this way, the swirl generated stabilizes the diffuser flow. The pressure recovery and the mass flow through the nozzle is increased. Introduction procedures which are located between an extreme secant-type inlet flow and a radial inlet flow are also possible. This provides less eddying and, in addition, a less powerful swirl, which again exerts and influences on the flow rate.

If the diffuser, through which flow occurs, has an opening angle of approximately 10° and there is a ratio of approximately 1:3 between the inlet area of the nozzle and the outlet area of the diffuser, a control range of the individual throttling element, which includes nozzle and diffuser, of 70% to 100% of the undisturbed flow rate can be achieved in the case of a radial introduction of the control fluid flow. This very wide control range can be adjusted by changing the pressure of the control fluid flow.

If the diffuser, through which flow occurs, has an opening angle of approximately 30° and there is a ratio of approximately 1:3 between the inlet area of the nozzle to outlet area of the diffuser, a diffuser is obtained which only generates a trivial pressure recovery. If, in this case, the control fluid flow is fed tangentially into the nozzle, the control range of the throttle element consisting of nozzle and diffuser reaches 100% to almost 140% of the unaffected flow rate of the cooling air flow during the control fluid pressure adjustment.

An extension of the control range of the throttle element can be achieved if a plurality of the appliances described above are connected in series or parallel, the cooling air flowing through the appliances. In this way, for example in the case of a series connection of throttle elements, a cooling air flow reduced in the case of radial incident flow to 70% of the undisturbed flow rate is again reduced in the case of flow through the second throttle element, by which it is possible to achieve a reduction of the undisturbed flow rate to approximately 50%. If the control flows fail, the originally adjusted undisturbed cooling air flow—as already mentioned above—flows again. A cooling air flow is therefore present in every case of disturbance of the control appliance, which is very advantageous for cooling purposes or other gas controls for ensuring a certain basic supply in order to prevent destruction of installations, for example because of a failure of a cooling function.

The control fluid flow can, in particular, be a control gas flow. Even hot or aggressive gases can be safely controlled by the appliance proposed. Mechanical parts, which could for example be damaged by oxidative or corrosive attack and would, because of this, lose their function, are—in association with the control gas flow—unnecessary for achieving a continuous control of the active gas flow. In order to control a hot active gas flow in the case of a very small control gas flow, it is not absolutely necessary for the control gas flow to have the same temperature as the active gas. This facilitates the generation and the introduction of the control gas flow because no sort of temperature measurement has to take place.

In the case of the use of the control appliance in a gas turbine, for example, both gas flows can also, however, be taken from the same gas source, which is compressed in the gas turbine, it being unnecessary for them to have the same gas parameters, such as pressure and temperature.

Very good utilization of the advantages, mentioned above, of the control appliance is possible in a gas turbine. A gas turbine, having rotor blades inserted on carrier disks, having stationary guide blades arranged between the carrier disks, cooling air flowing through the guide blades from a radially outer region to a radially inner region. The gas turbine further includes, between the respective rotor blade and guide blades, a carrier disk lateral space to which at least part of the cooling air flowing through the guide blade can be supplied. It has particularly high requirements with respect to the endurance and the freedom from maintenance of a throttle appliance for the cooling air emerging into the carrier disk lateral space, as has already been shown in the introduction. There are, in addition, severe effects due to high working gas temperatures.

With respect to the gas turbine, the object is achieved by at least one guide blade having, at a radially inner end region, an appliance which influences the cooling air supply to the carrier disk lateral space.

Such a control appliance blocks a supply of air from the hot gas duct from entering the carrier disk lateral space, and therefore prevents damage. This is done by cooling air expelled from the control appliance, air also designated as "blockage air", and by associated "excess pressure" in the carrier disk lateral space relative to the hot gas duct. By such an appliance, the cooling air supply is controlled directly at the radially inner end region of the guide blade during the inward flow of the cooling air into the carrier disk lateral space, and not previously in the cooling air supply duct to the guide blade. A control arrangement in the cooling air supply duct to the guide blade influences, as shown above, not only the cooling air supply to the carrier disk lateral space but also the cooling air supply to film cooling holes at the blade nose which, in the case of very low cooling air pressures, can lead to undesirable film breakdowns and therefore overheating of the blade nose. Control at the radially inner end region, which also includes adjacent components of the guide blade, for example, permits the required cooling air quantity to be minimized, which leads to a higher efficiency of the gas turbine without influencing the gas pressure at the film cooling holes. By the appliance proposed, the cooling air supply can be individually matched to the special geometry of the blades and of the carrier disk lateral spaces.

A particular effectively controllable and low-maintenance appliance for influencing the cooling air supply to the carrier disk lateral space of a gas turbine is provided by a control appliance being attached at the radially inner end region of a guide blade, by which the cooling air supply to the carrier disk lateral space can be controlled by a control air flow, as has been presented above in various forms. An embodiment of the invention then represents, so to speak, a pneumatic or aerodynamic quantity control of the blockage air.

The magnitude of the cooling air supply to the carrier disk lateral space does not have to be determined from the outset as soon as the guide blade is installed in the gas turbine, but can be subsequently adjusted by the control air flow with respect to the desired flow behavior at the radially inner end region. This is therefore particularly advantageous because, during the manufacturing process, no guide blade appliance corresponds exactly to another one. In this way, the cooling air supply can be optimized and the cooling air requirement can be minimized retrospectively by easy alterations to the cooling air flow. In this way, excessive cooling air is avoided but, at the same time, reliable cooling of the carrier disk lateral space is ensured.

An independent and low-maintenance appliance for supplying the cooling air flow to the throttle element at the radially inner end region of a guide blade is provided by it being possible to supply the control air flow through a feed duct to the transition peripheral region between the nozzle and the diffuser, the feed duct being provided within the guide blade and having a control appliance at its outer end region for adjusting the control air pressure. In this way, the control air flow at the radially inner end region of a guide blade can be adjusted, so to speak, "by remote control" without complex mechanical appliances being necessary for this purpose. The control air flow always keeps its own supply free from dirt and therefore permits a long life for the throttling appliance. The control takes place outside the inner radial end region of the guide blade, which is severely affected by high temperatures, and is therefore easily accessible for maintenance.

The function of the throttle appliance is, again, not impaired when it is subject to high temperature and it has a permanently high control rate. It can also be overloaded occasionally without damage, for example due to an excessively high pressure adjustment of the control air flow. The air flow then only impinges on the walls of the nozzle or the diffuser but cannot seriously damage them. In the case of failure of the control system, a basic flow of cooling air occurs in any event and this can be adjusted independently of the function of the control air flow before the gas turbine is put into operation. For example, this can be done by a predetermined size of the openings in the flow duct and a fixed adjustment of the cooling air flow, set in such a way that its flow is sufficient for the desired function. If the control air flow can be selected to be very small, the feed duct is also small and can therefore be easily accommodated within the guide blade. Outside the guide blade, it would interfere with the operation of the gas turbine and make control impossible.

A high level of continuity and a reliable supply of the control air flow can be ensured by the feed duct having an intermediate region between the control appliance, which is provided in its outer region, and the entry into the transition peripheral region between the nozzle and the diffuser, the intermediate regions being connected by appliances, which influence the cooling air supply, of a plurality of guide blades of a carrier disk. This intermediate region, which represents a type of reservoir for the control air flow, permits the supply of a constant control air flow even if, sometimes, small fluctuations occur in the supply of the control air or if the pressure changes. A connection between the intermediate spaces of different guide blades by a type of supply duct further stabilizes the control air pressure and, in addition, permits a reduction in the number of control appliances necessary for the control of the control air flow.

In addition, the intermediate region permits cooling of the material surrounding it and therefore also serves to reduce the temperature in the region of the radially inner end region of the guide blades.

BRIEF DESCRIPTION OF THE DRAWINGS

The appliance for and the method of controling the cooling air flow, in particular a gas turbine cooling air flow, are explained in more detail using the exemplary embodiments represented in the drawings. In these.

DETAILED DESCRIPTION OF THE PREFERRED EMBODIMENTS

Figure 1B:
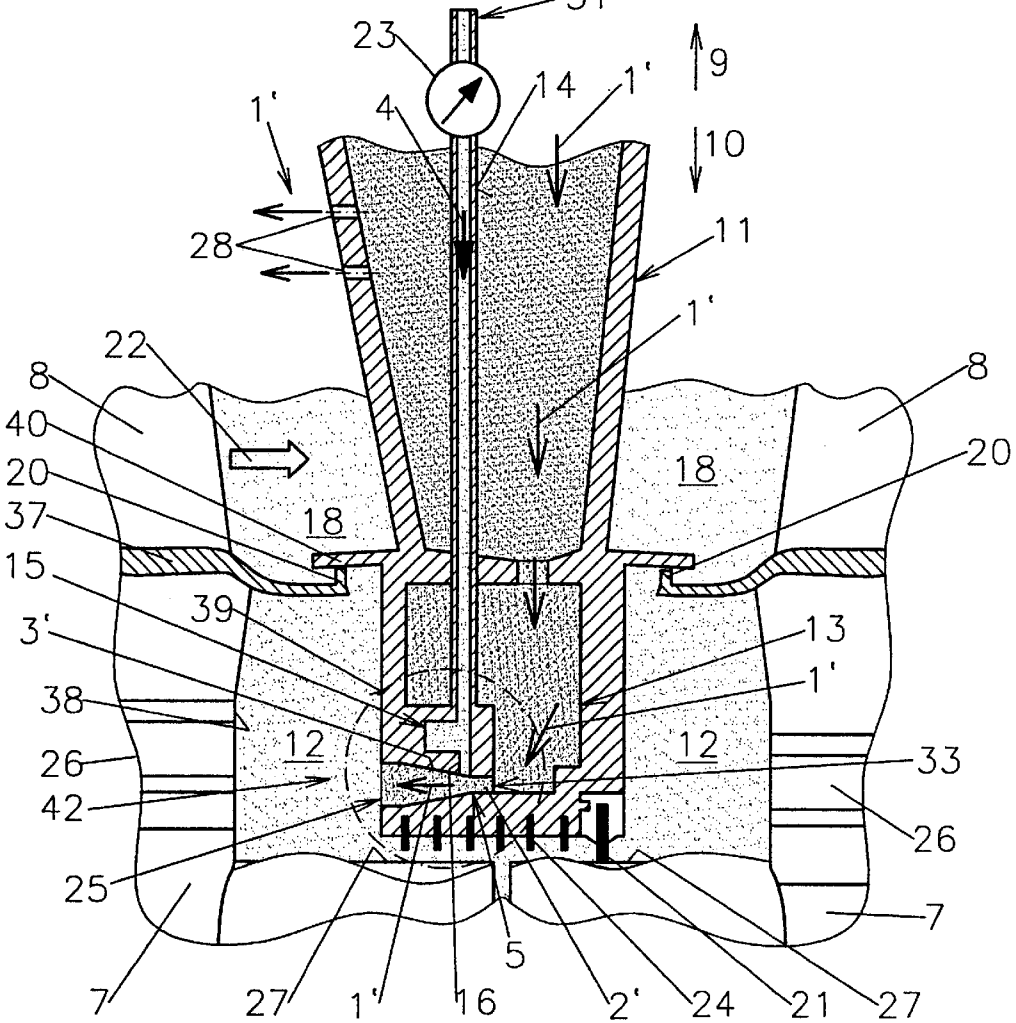
FIG. 1*b* shows, diagrammatically, a longitudinal section through an excerpt from a gas turbine.
Figure 1A:
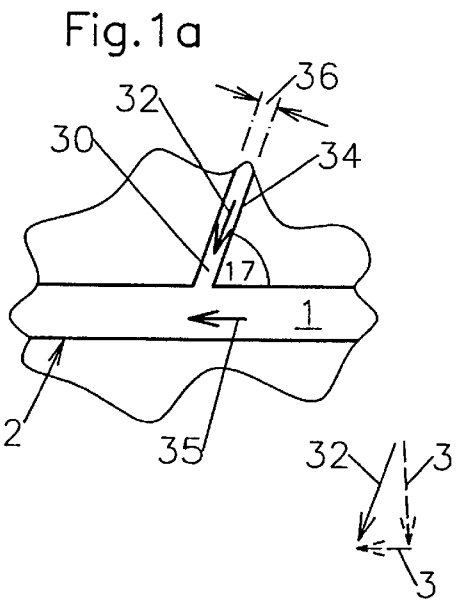
FIG. 1*a* shows, diagrammatically, an active fluid control appliance in longitudinal section.

FIG. 1*a* shows, diagrammatically, not to scale and in principle the construction of an active fluid control appliance. The active fluid 1 flows through a flow duct 2. The shape of the flow duct 2 is not specified but is here assumed to be cylindrical. A control fluid duct 34 is provided to the side of the flow duct 2 and a control fluid flow 30 is supplied to the cooling air flow 1 flowing through the flow duct 2 by this cooling fluid duct 34. The geometry of the cooling fluid duct 34 is likewise not specified, in particular the transition 45 from the cooling fluid duct 34 to the flow duct 2. Depending on whether it is desired to generate a laminar or a turbulent flow, it is appropriate to select a corresponding transition 45, for example matched, rounded edges. The control fluid flow 30 can be resolved into at least two flow components 3, one flow component 3 being always provided transverse to the flow direction 30 of the cooling air flow through the flow duct 2. This resolution into flow components 3 should be understood vectorially, in the resolution one flow component 3 being selected in such a way that it is parallel to the flow direction 35 of the cooling air flow 1 through the flow duct 2.

Figure 2A:
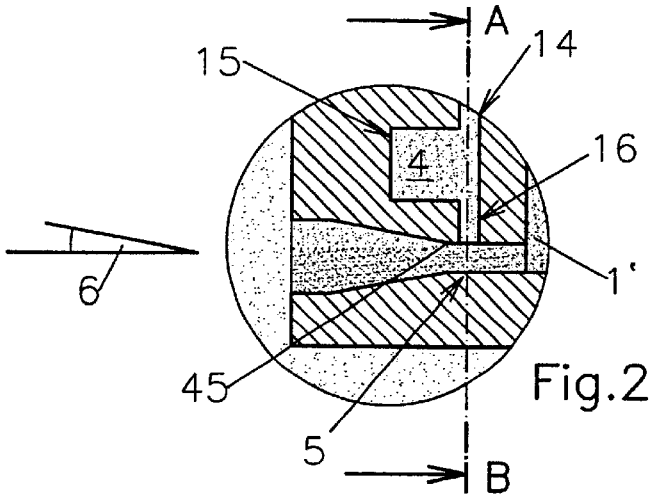
FIG. 2*a* shows an enlarged excerpt from FIG. 1*b* relating to a throttle element with radial control air supply.
Figure 3A:
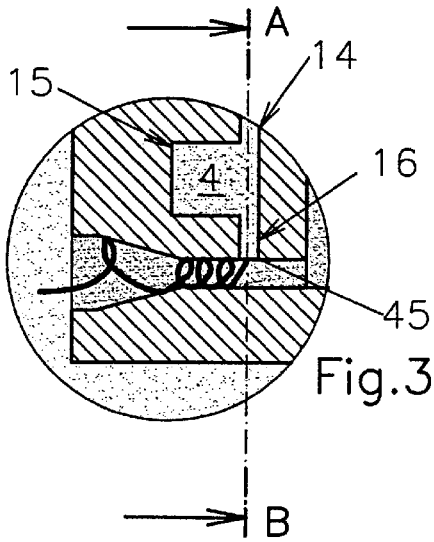
FIG. 3*a* shows an enlarged excerpt from FIG. 1*b*, having a control appliance with tangential air supply.

The flow rate of the cooling air flow 1 can be adjusted by the control fluid flow 30, which is introduced into the cooling air flow 1. This occurs because the flow behavior of the cooling air flow 1 is altered by the introduction of the control fluid flow 30. Two primary alterations to the flow rate are fundamentally conceivable, on the one hand acceleration of and, on the other, hindrance to the flow of the cooling air by the laterally introduced control fluid flow 30. The strength and type of the control of the cooling air flow 1 by the control fluid flow 30 depends, on the one hand, on the introduction geometry of the control fluid flow 30 into the cooling air flow 1. By this is to be understood, for example, the transition 45 from the cooling fluid duct 34 to the flow duct 2, for example an arrangement with edges or a rounded arrangement. The angles 17 at the transition 45 between the control fluid duct 34 and the flow duct 2 can also be altered and, therefore, the direction of the entering control fluid flow 30. The size of the control fluid duct 34, in particular its thickness 36, can also be altered. Further influence possibilities lie, for example, in the selection of a certain geometry of the flow duct 2. As an example, the flow duct can be selected to be larger or narrower or to have a funnel-shaped outlet opening 25, as is represented in FIGS. 1*b*, 2*a* and 3*a*. If the arrangement geometries are fixed, the cooling air flow 1 can still be adjusted as a function of control parameters of the control fluid flow 30. The adjustment of the pressure of the control fluid flow 30 is, in particular, proposed as a control parameter.

Control of the cooling air flow 1 by a control fluid flow 30 is possible, even with very small flow rates of the control fluid flow 30. In this way, the cooling fluid duct 34 can be kept very small relative to the flow duct 2 and the overall appliance can also be easily accommodated at very inaccessible locations, for example, within machines.

FIG. 1*b* shows, diagrammatically and not to scale, an excerpt from a gas turbine with rotor blades 8 inserted on carrier disks 7 and with stationary guide blades 11 arranged between the carrier disks 7. In this arrangement, the rotor blades 8 are driven by the hot gas flow 22, the hot gas flow 22 flowing through between the rotor blades 8 and the guide blades 11. In this arrangement, both the rotor blades 8 and the guide blades 11, which are fitted in a stationary manner at the periphery of the gas turbine, are subject to the high temperatures of the hot gas flow 22. Although the blades are manufactured from a high-temperature resistant material, further cooling is frequently necessary.

The cooling of the guide blade 11 represented in FIG. 1*b* lies in cooling air 1' from the periphery of the gas turbine being led to the radially outer region 9, through the inside of the guide blade 11 as far as a radially inner region 10 of the guide blade 11. The discharge: of the cooling air 1' essentially takes place at the film cooling holes 28, which generate a cooling film on the outside of the guide blade 11, and also by a discharge duct in the radially inner region 10 of the guide blade 11, which duct has a nozzle 2' and a diffuser 3'. In this arrangement, the emerging cooling air 1' is guided into a carrier disk lateral space 12, which is formed in each case between one rotor blade 8 and one guide blade 11. The carrier disk lateral space 12 is essentially bounded by the side wall 38 of the root 26 of the rotor blade 8, an upper region 27, which is adjacent to the carrier disk 7 and to which the root 26 of the rotor blade 8 is fastened, a lower side wall 39 of the guide blade 11 and the collar 37 of the rotor blade 8 and the collar 40 of the guide blade 11, the collars being sealed relative to one another by way of a sealing lip 20. This connection of the two collars 37 and 40 separates the hot gas duct 18 for the hot gas flow 22 from the carrier disk lateral space 12. The hot gas air 22 can, however, partially penetrate into the carrier disk lateral space 12 at the sealing lip 20 and heat the carrier disk lateral space 12 in an undesirable manner; this is prevented by the cooling arrangement proposed.

At its radially inner region 10, the guide blade 11 is provided with transition seals 24, the end seal 21, in particular, between the radially inner region 10 of the guide blade 11 and the wall 27, which is adjacent to the carrier disk lateral space 12 which is in contact with the carrier disk 7, separates—from one another—two carrier disk lateral spaces 12 adjacent to the guide blade 11. The cooling air 1' emerging through the nozzle 2' and the diffuser 3' is controlled by a control appliance 23 which feeds, via a feed duct 14 which extends radially through the inside of the guide blade, a control air flow 4 to a widened intermediate region 15. From this, a duct 16 leads off which introduces the control air flow 4 supplied into the nozzle 2', or into the diffuser 3' or into the transition peripheral region 5 between the nozzle 2' and the diffuser 3'. The control air flow 4 is controlled by a control appliance 23, which is preferably located at the upper region of the feed duct 14. In this way, a control air flow 4, which increases or reduces the flow rate of the cooling air flow 1', is supplied at varying flow strength to the cooling air flow 1' emerging through the nozzle 2' and the diffuser 3'.

Figure 2B:
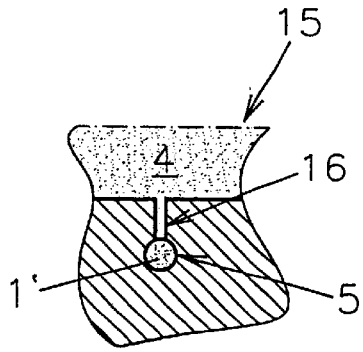
FIG. 2*b* shows a cross section through a control appliance with radial control air supply.
Figure 3B:
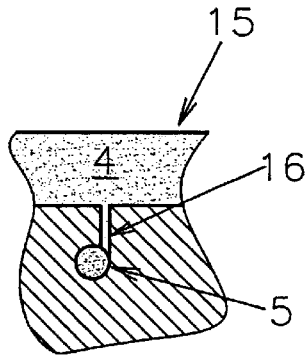
FIG. 3*b* shows a cross section through a control appliance with tangential control air supply as shown in FIG. 3*a*.

The strengthening function occurs particularly when, as shown in FIG. 3*a* or 3*b*, the duct 16 leading away from the widened intermediate region 15 is brought in the manner of a secant to the transition peripheral region 5, so that a swirl occurs which entrains the cooling air 1' flowing through and, in this way, increases the flow rate. A reduction in the flow rate occurs particularly when, as shown in FIGS. 2*a* and 2*b*, the duct 16 leading away from the intermediate region 15 is inserted radially, i.e. almost centrally therefore, into the region of the nozzle 2', so that the entering control air 4 compresses the through-flow cooling air flow 1', or reduces its flow rate.

Fixed control ranges of the control appliance can be achieved at a certain, specified ratio between the inlet area 30 of the nozzle 2' and the outlet area 25 of the diffuser 3'.

Because of the long and extremely thin feed duct 14, which supplies the control air within the guide blade 11 to the widened intermediate region 15, it is also possible, at a more remote control appliance 23, to have an influence on the "remotely controlled" adjustment procedures in the throttle element 42. In this way, an almost maintenance-free throttle element is obtained at the radially inner end region 13 of the guide blade 11, which can also include adjacent components, i.e. at a position in the guide blade 11 which has poor access for conventional control and maintenance procedures. At the same time, however, an economical use of the cooling air 1' is ensured by the control air flow 4 being easily adjusted by the control system 23 in such a way that only the precisely required cooling air quantity 1' flows out through the nozzle 2' or the diffuser 3' into the carrier disk lateral space 12, and not an unnecessarily powerful cooling air flow 1. The accurate adjustment also prevents breakdown of the film cooling by means of the cooling air 1' flowing through the film cooling holes 28.

Figure 4:
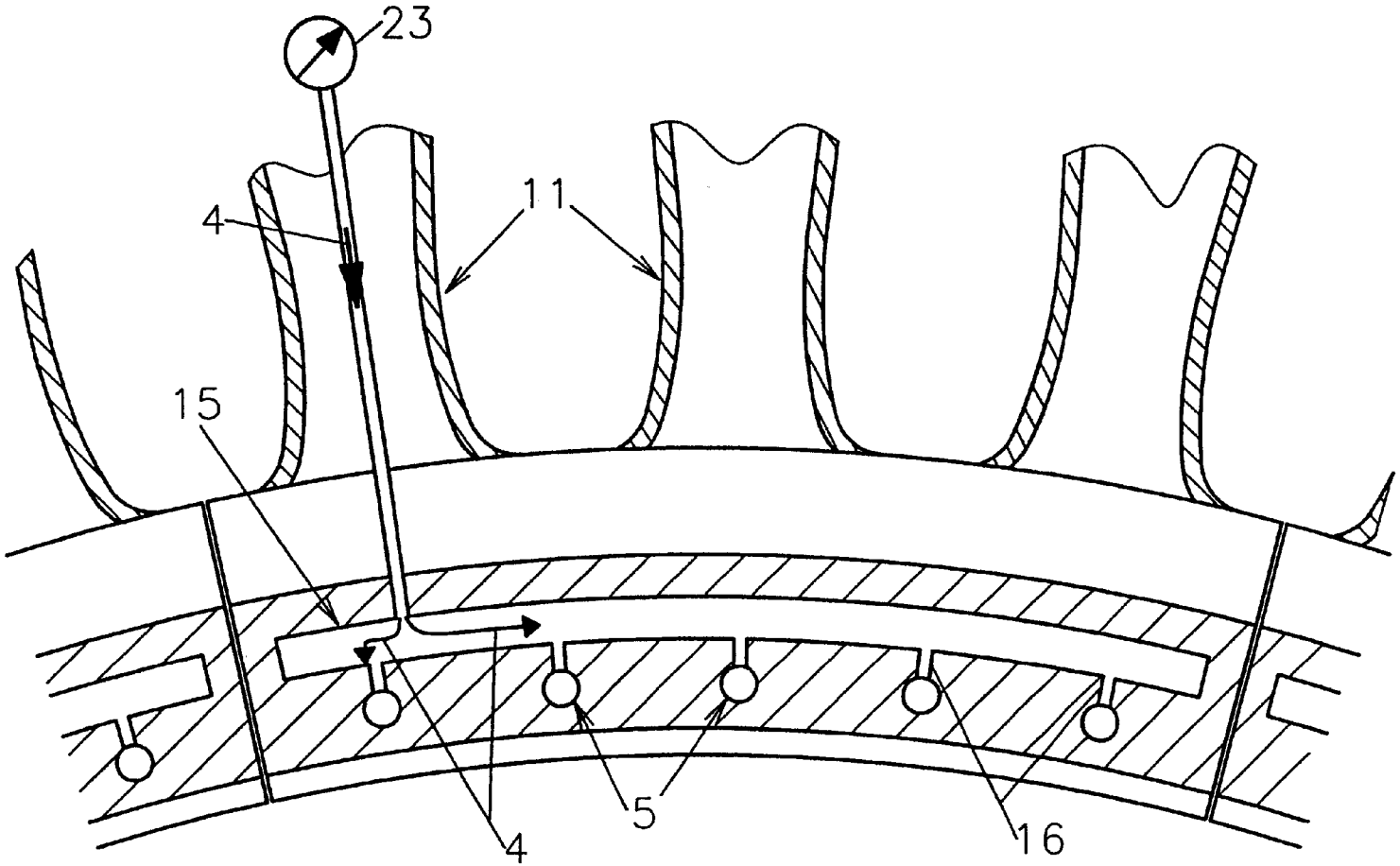
FIG. 4 shows a longitudinal section through a plurality of guide blades with connected control appliances.

FIG. 4 shows a longitudinal section through a plurality of control appliances, of adjacent guide blades 11, connected by a widened intermediate region 15. In this arrangement, the control air flow 4 is controlled by a control system 23 for a plurality of guide blades 11; a plurality of control systems 23 can also, however, be applied.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for controlling a cooling air flow which flows through a flow duct of a gas turbine, comprising:

a control fluid flow channel, including a control fluid flow introduced into the flow duct, with a flow component transverse to the flow direction of the cooling air flow through the flow duct, wherein a flow rate of the cooling air flow is influenced as a function of the control fluid flow, said control fluid flow being dynamically variable.

2. The apparatus as claimed in claim 1, wherein the flow rate of the cooling air flow is adjustable as a function of control parameters of the control fluid flow.

3. The apparatus as claimed in claim 2, wherein the flow rate of the cooling air flow is adjustable by adjusting the pressure of the control fluid flow.

4. The apparatus as claimed in claim 1, wherein the flow rate of the cooling air flow is adjustable by adjusting the pressure of the control fluid flow.

5. The apparatus as claimed in claim 1, wherein the flow rate of the control fluid flow is small relative to the flow rate of the cooling air flow.

6. The a apparatus as claimed in claim 1, wherein the control fluid flow is radially introducable into the cooling air flow flowing through the flow duct.

7. The apparatus as claimed in claim 1, wherein the control fluid flow is tangentially introducable into the cooling air flow flowing through the flow duct.

8. The apparatus as claimed in claim 1, wherein the control fluid flow is introducable in the manner of a secant into the cooling air flow flowing through the flow duct.

9. The apparatus as claimed in claim 1, wherein the flow duct includes a nozzle and a downstream diffuser with a specified opening angle, and wherein the control fluid flow is introducable in a transitional peripheral region between the nozzle and the diffuser.

10. The apparatus as claimed in claim 9, wherein the diffuser, through which flow occurs, includes an opening angle of approximately 30° and wherein there is a ratio of approximately 1:3 between an inlet area of the nozzle and an outlet area of the diffuser.

11. The apparatus as claimed in claim 9, wherein the diffuser, through which flow occurs, includes an opening angle of approximately 10° and wherein there is a ratio of approximately 1:3 between an inlet area of the nozzle and an outlet area of the diffuser.

12. The apparatus as claimed in claim 1, comprising:

a plurality of apparatuses connected in series or parallel, with the cooling air flow flowing through the apparatuses.

13. The apparatus as claimed in claim 1, wherein the cooling air flow is an effective gas flow and the control fluid flow is a control gas flow.

14. The apparatus as claimed in claim 1, wherein the flow of the cooling air is further influenced by an angle of the control fluid flow channel with respect to the flow duct.

15. The apparatus as claimed in claim 1, wherein the flow of the cooling air is further influenced by the shape of the flow duct.

16. The apparatus as claimed in claim 1, wherein the flow of the cooling air is further influenced by an angle of the control fluid flow channel with respect to the flow duct and the shape of the flow duct.

17. A gas turbine comprising:

rotor blades inserted in carrier disks;

stationary guide blades arranged between the carrier disks, wherein cooling air flows through the guide blades from a radially outer region to a radially inner region; and between the rotor blades and the guide blades, a respective carrier disk lateral space to which at least part of the cooling air flowing through the guide blades is supplied, wherein at least one guide blade includes, on a radially inner end region, an apparatus which influences cooling air supply, said apparatus including a control fluid flow channel permitting control fluid to influence the cooling air flow, said control fluid flow being dynamically variable.

18. The gas turbine as claimed in claim 17, wherein an apparatus influencing cooling air supply is provided at the radially inner end region of said at least one guide blade, by which the cooling air supply to the carrier disk lateral space is controllable by a control air flow.

19. The gas turbine as claimed in claim 18, wherein the control air flow is supplyable through a feed duct to the transition peripheral region between the nozzle and the diffuser, the feed duct being provided within the guide blade and including a control apparatus in its outer region for adjusting the control air pressure.

20. The gas turbine as claimed in claim 17, wherein the control air flow is suppliable through a feed duct to the transition peripheral region between the nozzle and the diffuser, the feed duct being provided within the said at least one guide blade and including a control apparatus in its outer region for adjusting the control air pressure.

21. The gas turbine as claimed in claim 17, wherein the feed duct includes an intermediate region between the control apparatus, provided in its outer region, and its entry into the transitional peripheral region between the nozzle and the diffuser, the intermediate regions being connected by more than one apparatuses, which influence the cooling air supply, of the guide blades of the carrier disks.

22. The gas turbine as claimed in claim 17,wherein the flow of the cooling air is further influenced by an angle of the control fluid flow channel with respect to the flow duct.

23. The gas turbine as claimed in claim 17, wherein the flow of the cooling air is further influenced by the shape of the flow duct.

24. The gas turbine as claimed in claim 17, wherein the flow of the cooling air is further influenced by an angle of the control fluid flow channel with respect to the flow duct and the shape of the flow duct.

25. A method of controlling a cooling air flow which flows through a flow duct comprising:

introducing a control fluid flow into the cooling air flow, in the region of the flow duct, with a flow component transverse to the flow direction of the cooling air flow through the flow duct; and adjusting the flow rate of the cooling air flow as a function of the control fluid flow, said control fluid flow being dynamically adjustable.

26. The method as claimed in claim 25, wherein the flow rate of the cooling air flow is adjusted as a function of control parameters of the control fluid flow.

27. The method as claimed in claim 26, wherein the flow rate of the cooling air flow is adjusted by adjusting the pressure of the control fluid flow.

28. The method as claimed in claim 25, wherein the flow rate of the cooling air flow is adjusted by adjusting the pressure of the control fluid flow.

29. The method as claimed in claim 25, wherein the flow rate of the control fluid flow is small relative to the flow rate of the cooling air flow.

30. The method as claimed in claim 25, wherein the control fluid flow is introduced radially into the cooling air flow flowing through the flow duct.

31. The method as claimed in claim 25, wherein the control fluid flow is introduced tangentially into the cooling air flow flowing through the flow duct.

32. The method as claimed in claim 25, wherein the control fluid flow is introduced in the manner of a secant into the cooling air flow flowing through the flow duct.

33. The method as claimed in claim 25, wherein the cooling air flow flows through a nozzle and a downstream diffuser with a specified opening angle, and the control fluid flow is introduced in a transitional peripheral region between the nozzle and the diffuser.

34. The method as claimed in claim 33, wherein the diffuser, through which flow occurs, includes an opening angle of approximately 30°, and wherein there is a ratio of approximately 1:3 between an inlet area of the nozzle and an outlet area of the diffuser.

35. The method as claimed in claim 33, wherein the diffuser, through which flow occurs, includes an opening angle of approximately 10°, and wherein there is a ratio of approximately 1:3 between an inlet area of the nozzle and an outlet area of the diffuser.

36. The method as claimed in claim 25, wherein the cooling air flow is controlled by a plurality of apparatuses connected in series or parallel.

37. The method as claimed in claim 25, wherein the cooling air flow is an effective gas flow and the control fluid flow is a control gas flow.

38. The method as claimed in claim 25, wherein the flow of the cooling air is further influenced by an angle of the control fluid flow channel with respect to the flow duct.

39. The method as claimed in claim 25, wherein the flow of the cooling air is further influenced by the shape of the flow duct.

40. The method as claimed in claim 25, wherein the flow of the cooling air is further influenced by an angle of the control fluid flow channel with respect to the flow duct and the shape of the flow duct.

* * * * *